US012263553B2

(12) United States Patent
Yamamoto

(10) Patent No.: US 12,263,553 B2
(45) **Date of Patent: *Apr. 1, 2025**

(54) GRINDING METHOD FOR WORKPIECE AND GRINDING APPARATUS

(71) Applicant: DISCO CORPORATION, Tokyo (JP)

(72) Inventor: Keisuke Yamamoto, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 723 days.

This patent is subject to a terminal disclaimer.

(21) Appl. No.: 17/457,090

(22) Filed: Dec. 1, 2021

(65) Prior Publication Data

US 2022/0088742 A1 Mar. 24, 2022

(51) Int. Cl.
*B24B 37/10* (2012.01)
*B24B 7/22* (2006.01)
(Continued)

(52) U.S. Cl.
CPC ..... *B24B 19/02* (2013.01); *B24B 7/228* (2013.01); *B24B 37/005* (2013.01);
(Continued)

(58) Field of Classification Search
CPC ..... B24B 7/228; B24B 19/02; B24B 37/005; B24B 37/04; B24B 37/042; B24B 37/07; B24B 37/10; B24B 37/12; B24B 37/30; B24B 41/002; B24B 41/047; B24B 41/0475; B24B 41/053
(Continued)

(56) References Cited

U.S. PATENT DOCUMENTS 6,193,586 B1 * 2/2001 Park ..... B24B 41/061 451/388
6,966,826 B2 11/2005 Suzuki et al.
(Continued)

FOREIGN PATENT DOCUMENTS

DE 102012020522 A1 4/2014
DE 102021207222 A1 1/2022
(Continued)

OTHER PUBLICATIONS

Office Action issued in counterpart German patent application No. 10 2021 213 524.2, dated Mar. 10, 2023.
(Continued)

*Primary Examiner* — Eileen P Morgan
(74) *Attorney, Agent, or Firm* — GREER BURNS & CRAIN, LTD.

(57) ABSTRACT

A grinding method for grinding a workpiece by use of a grinding apparatus including a holding table that holds the workpiece by a holding surface, and a grinding unit that grinds the workpiece held by the holding table by a grinding wheel having a plurality of grindstones arranged in an annular pattern includes a groove forming step of grinding the workpiece by bringing the grindstones into contact with the workpiece to form the workpiece with an arcuate groove having a depth of less than a finished thickness of the workpiece, and a grinding step of bringing the grindstones into contact with a surface side of the workpiece where the groove is formed to grind the workpiece until the thickness of the workpiece becomes the finished thickness.

5 Claims, 6 Drawing Sheets

(51) Int. Cl.

| | |
|---|---|
| ***B24B 19/02*** | (2006.01) |
| ***B24B 37/005*** | (2012.01) |
| ***B24B 37/04*** | (2012.01) |
| ***B24B 41/047*** | (2006.01) |
| ***B24B 41/053*** | (2006.01) |

(52) U.S. Cl.
CPC ..... *B24B 37/042* (2013.01); *B24B 37/10* (2013.01); *B24B 41/047* (2013.01)

(58) Field of Classification Search
USPC ..... 451/41, 57, 58, 63, 65, 278, 285, 287
See application file for complete search history.

(56) References Cited

U.S. PATENT DOCUMENTS

| | | | | |
|---|---|---|---|---|
| 7,022,000 | B2 | 4/2006 | Mizomoto et al. | |
| 7,462,094 | B2 * | 12/2008 | Yoshida | B24B 1/00 451/63 |
| 7,527,547 | B2 | 5/2009 | Kajiyama et al. | |
| 7,758,402 | B2 * | 7/2010 | Yoshida | B24B 7/228 438/959 |
| 7,892,072 | B2 | 2/2011 | Lee et al. | |
| 9,649,775 | B2 | 5/2017 | Kumazawa | |
| 10,112,285 | B2 | 10/2018 | Fujiya et al. | |
| 11,524,386 | B2 * | 12/2022 | Matsubara | B24B 37/30 |
| 11,590,630 | B2 * | 2/2023 | Suzuki | B24B 27/0076 |
| 11,717,927 | B2 * | 8/2023 | Suzuki | B24B 7/228 451/28 |
| 2008/0076334 | A1 * | 3/2008 | Yoshida | B24B 7/228 451/177 |
| 2013/0001766 | A1 * | 1/2013 | Takyu | H01L 21/304 257/734 |
| 2022/0088742 | A1 * | 3/2022 | Yamamoto | B24B 19/02 |
| 2022/0324082 | A1 * | 10/2022 | Suzuki | B24B 41/068 |
| 2022/0336221 | A1 * | 10/2022 | Lee | B23K 26/0622 |
| 2022/0344163 | A1 | 10/2022 | Suzuki | |
| 2022/0362900 | A1 * | 11/2022 | Suzuki | B24B 7/228 |
| 2023/0105522 | A1 * | 4/2023 | Sakamoto | B24B 7/04 451/285 |
| 2023/0234182 | A1 * | 7/2023 | Nakamura | B24B 7/228 |
| 2023/0302603 | A1 * | 9/2023 | Mase | B24B 49/00 |

FOREIGN PATENT DOCUMENTS

| | | | | |
|---|---|---|---|---|
| JP | 2009090389 | A | 4/2009 | |
| WO | WO-2005070619 | A1 * | 8/2005 | B24B 1/00 |

OTHER PUBLICATIONS

Office Action issued in counterpart German patent application No. 10 2021 213 524.2, dated Oct. 26, 2022.

* cited by examiner

GRINDING METHOD FOR WORKPIECE AND GRINDING APPARATUS

BACKGROUND OF THE INVENTION

Field of the Invention

The present invention relates to a grinding method for a workpiece and a grinding apparatus for grinding a workpiece.

Description of the Related Art

In a manufacturing process of device chips, a wafer formed with devices such as an integrated circuit (IC) and large scale integration (LSI) respectively in regions partitioned by a plurality of intersecting streets is used. By dividing the wafer along the streets, a plurality of device chips respectively including the devices are manufactured. The device chips are mounted on various electronic apparatuses such as mobile phones and personal computers.

In recent years, attendant on a reduction in size of electronic apparatuses, thinning of the device chips has been demanded. In view of this, a technique of applying grinding to the wafer before division to thin the wafer is used. For grinding of the wafer, a grinding apparatus including a holding table that holds the wafer and a grinding unit that grinds the wafer is used. To the grinding unit of the grinding apparatus, a grinding wheel having a plurality of grindstones arranged in an annular pattern is mounted. The grindstones are formed by fixing abrasive grains of diamond or the like with a bonding material. In a state in which the wafer is held by the holding table, the grindstones are brought into contact with the wafer while rotating the holding table and the grinding wheel, whereby the wafer is ground (see Japanese Patent Laid-open No. 2009-90389).

SUMMARY OF THE INVENTION

In grinding, the abrasive grains projecting from the bonding material of the grindstones make contact with the workpiece, whereby the workpiece is processed. Therefore, it is desired that the state in which the abrasive grains project appropriately from the bonding material is maintained during the grinding of the workpiece. When the grindstones collide on the workpiece, the abrasive grains successively drop from the bonding material. However, when grinding is continued even after the droppage of the abrasive grains, a phenomenon called spontaneous edge sharpening in which the bonding material is abraded by contact with the workpiece with a result that new abrasive grains are exposed from the bonding material is generated. By the spontaneous edge sharpening, the state in which the abrasive grains project from the bonding material is maintained, and a lowering in a grinding ability of the grindstones is prevented.

However, it is to be noted that depending on the material of the workpiece and the state of the ground surface of the workpiece, the timing of dropping of the abrasive grains may be advanced. For example, when a thin film such as an oxide film is formed on the ground surface of the workpiece, the abrasive grains are captured by the thin film, and the dropping of the abrasive grains is liable to occur. In such a case, the period from the droppage of the abrasive grains to completion of the spontaneous edge sharpening, namely, the period of grinding of the workpiece in a state in which the grinding ability of the grindstones is low, is prolonged, and defective grinding of the workpiece is liable to occur.

The present invention has been made in consideration of such a problem. It is an object of the present invention to provide a grinding method for a workpiece and a grinding apparatus that can restrain generation of defective processing.

In accordance with an aspect of the present invention, there is provided a grinding method for a workpiece for grinding the workpiece by a grinding apparatus including a holding table that holds the workpiece by a holding surface, and a grinding unit that grinds the workpiece held by the holding table by a grinding wheel having a plurality of grindstones arranged in an annular pattern. The grinding method includes a groove forming step of grinding the workpiece by bringing the grindstones into contact with the workpiece, in a state in which the holding table is not rotated and the grinding wheel is rotated, to form the workpiece with an arcuate groove having a depth of less than a finished thickness of the workpiece, and a grinding step of bringing the grindstones into contact with a surface side of the workpiece where the groove is formed, in a state in which the holding table and the grinding wheel are rotated, to grind the workpiece until the thickness of the workpiece becomes the finished thickness.

Note that, preferably, in the groove forming step, an angle in a rotating direction of the holding table is set to a predetermined angle. In addition, preferably, in the groove forming step, the workpiece is ground respectively in states in which angles in the rotating direction of the holding table are different, to form the workpiece with a plurality of the grooves.

In accordance with another aspect of the present invention, there is provided a grinding apparatus including, a holding table that holds a workpiece by a holding surface, a grinding unit that grinds the workpiece held by the holding table by a grinding wheel having a plurality of grindstones arranged in an annular pattern, a grinding feeding unit that relatively moves the holding table and the grinding unit along a direction perpendicular to the holding surface, and a control unit that controls the holding table, the grinding unit, and the grinding feeding unit, in which the control unit can changes over a first mode of bringing the grindstones into contact with the workpiece by the grinding feeding unit, in a state in which the holding table is not rotated and the grinding wheel is rotated, to form the workpiece with a groove having a depth of less than a finished thickness of the workpiece, and a second mode of bringing the grindstones into contact with a surface side of the workpiece where the groove is formed by the grinding feeding unit, in a state in which the holding table and the grinding wheel are rotated.

Note that, preferably, the control unit can control an angle in a rotating direction of the holding table.

In the grinding method and the grinding apparatus according to one aspect of the present invention, after the arcuate groove having a depth of less than the finished thickness of the workpiece is formed in the workpiece, the grindstone is brought into contact with a surface side of the workpiece where the groove is formed, whereby the workpiece is ground until the thickness of the workpiece becomes the finished thickness. By this, when the workpiece is ground and thinned, the grindstones collide against the groove and spontaneous edge sharpening is promoted. As a result, the grinding ability of the grindstones is maintained, and generation of defective processing is restrained.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
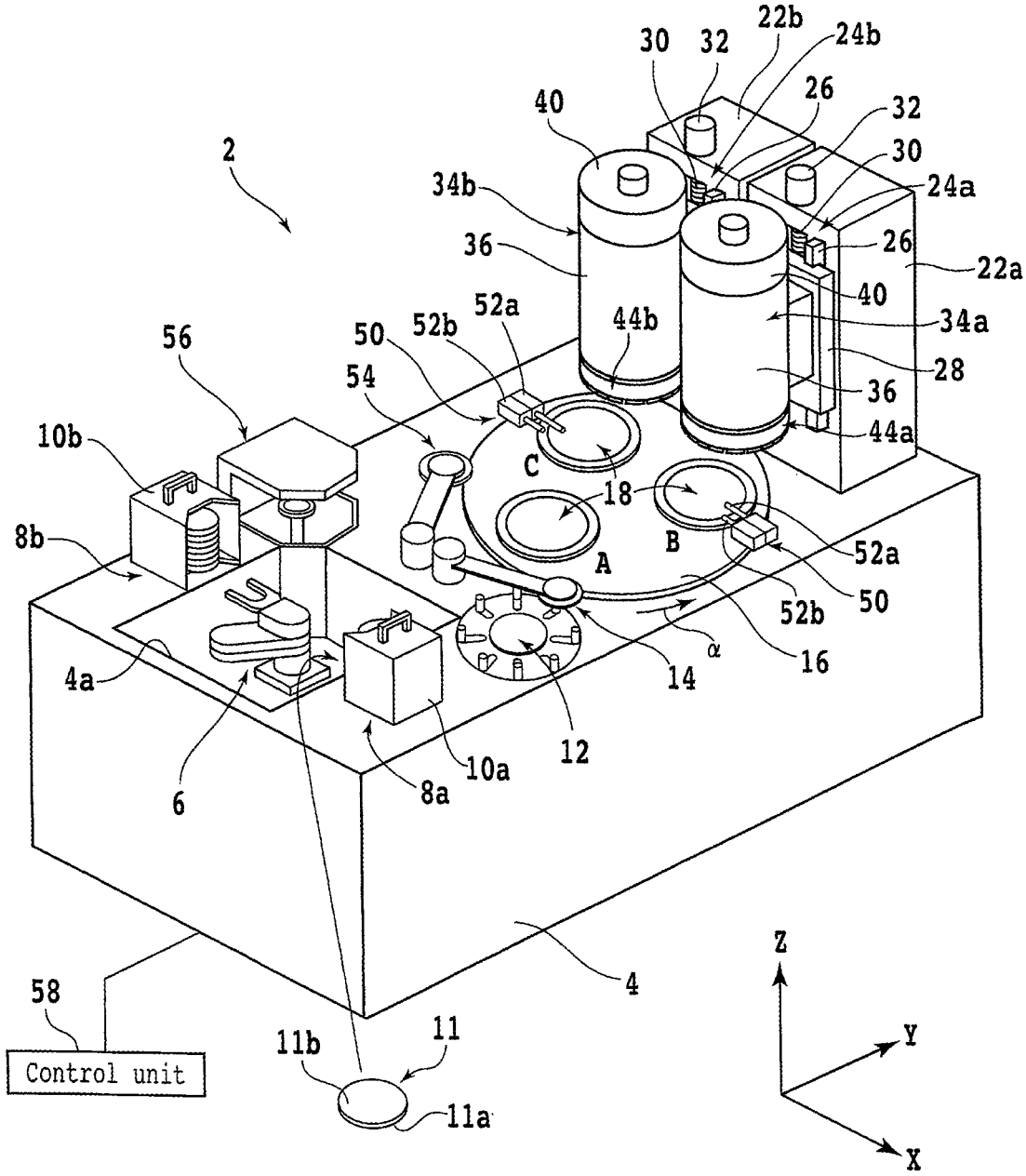
FIG. 1 is a perspective view depicting a grinding apparatus.

An embodiment according to one mode of the present invention will be described below referring to the attached drawings. First, a configuration example of a grinding apparatus capable of being used in a grinding method for a workpiece according to the present embodiment will be described. FIG. 1 is a perspective view depicting a grinding apparatus 2. Note that, in FIG. 1, an X-axis direction (left-right direction, first horizontal direction) and a Y-axis direction (front-rear direction, second horizontal direction) are directions perpendicular to each other. In addition, a Z-axis direction (vertical direction, upward-downward direction, height direction) is a direction perpendicular to the X-axis direction and the Y-axis direction.

The grinding apparatus 2 includes a base 4 that supports and accommodates constituent elements of the grinding apparatus 2. A rectangular opening 4*a* is provided on an upper surface side of a front end part of the base 4, and a conveying unit (conveying mechanism) 6 that conveys a workpiece 11 to be processed by the grinding apparatus 2 is provided in the inside of the opening 4*a*. Cassette setting regions 8*a* and 8*b* are provided on both sides of the conveying unit 6. Cassettes 10*a* and 10*b* that accommodate the workpieces 11 are set respectively on the cassette setting regions 8*a* and 8*b*. A plurality of workpieces 11 (workpieces 11 before processing) scheduled to be processed by the grinding apparatus 2 are accommodated in the cassette 10*a*. On the other hand, a plurality of workpieces 11 (workpieces 11 after processing) processed by the grinding apparatus 2 are accommodated in the cassette 10*b*.

For example, the workpiece 11 is a silicon wafer formed in a disk shape and includes a front surface (first surface) 11*a* and a back surface (second surface) 11*b* which are substantially parallel to each other. The workpiece 11 is partitioned into a plurality of rectangular regions by a plurality of streets arranged in a grid pattern such as to intersect each other. Devices such as an IC and LSI are formed respectively on the front surface 11*a* side of the regions partitioned by the streets. By dividing the workpiece 11 along the streets, a plurality of device chips including the devices respectively are manufactured. In addition, by thinning by grinding the workpiece 11 by the grinding apparatus 2 before division of the workpiece 11, thinned device chips are obtained. However, it is to be noted that a kind, a material, a size, a shape, a structure, and the like of the workpiece 11 are not limited. For example, the workpiece 11 may be a substrate formed from a semiconductor other than silicon (GaAs, InP, GaN, SiC, etc.), a glass, a ceramic, a resin, a metal, or the like. In addition, the kind, the number, the shape, the structure, the size, the layout, and the like of the devices formed on the workpiece 11 are also not limited, and the workpiece 11 may not be formed with the devices.

On an obliquely rear side of the opening 4*a*, an alignment mechanism 12 is provided. The workpieces 11 accommodated in the cassette 10*a* are conveyed to the alignment mechanism 12 by the conveying unit 6. Then, the alignment mechanism 12 disposes the workpiece 11 by matching to a predetermined position.

At a position adjacent to the alignment mechanism 12, a conveying unit (conveying mechanism, loading arm) 14 that conveys the workpiece 11 is provided. The conveying unit 14 includes a suction pad that holds the upper surface side of the workpiece 11 under suction. Then, the conveying unit 14 holds the workpiece 11 having undergone alignment by the alignment mechanism 12 by the suction pad, and turns the suction pad, thereby conveying the workpiece 11 rearwards.

On a rear side of the conveying unit 14, a disk-shaped turntable 16 is provided. A rotational drive source (not illustrated) such as a servo motor is connected to the turntable 16, and the rotational drive source rotates the turntable 16 around a rotational axis substantially parallel to the Z-axis direction. On the turntable 16, a plurality of holding tables (chuck tables) 18 that hold the workpiece 11 are provided. FIG. 1 depicts an example in which three holding tables 18 are disposed at substantially regular intervals along the circumferential direction of the turntable 16. The turntable 16 is rotated counterclockwise (in the direction indicated by an arrow a) in a plan view, and positions each holding table 18 at a conveying position A, a first grinding position (rough grinding position) B, a second grinding position (finish grinding position) C, and a conveying position A in this order.

A rotational drive source 20 (see FIG. 2) for rotating the holding table 18 is connected to the holding table 18. For example, the rotational drive source 20 is a servo motor, and rotates the holding table 18 around a rotational axis substantially parallel to the Z-axis direction. Note that the rotational drive source 20 includes a detector (encoder) that detects the rotational angle of an output shaft of the rotational drive source 20 (rotational angle of the holding table 18).

A columnar support structure 22*a* is disposed on the rear side of the first grinding position B, and a columnar support structure 22*b* is disposed on the rear side of the second grinding position C. A grinding feeding unit (moving unit, moving mechanism) 24*a* is provided on a front surface side of the support structure 22*a*, and a grinding feeding unit (moving unit, moving mechanism) 24*b* is provided on a front surface side of the support structure 22*b*. Each of the grinding feeding units 24*a* and 24*b* includes a pair of guide rails 26 disposed substantially parallel to the Z-axis direction. A plate-shaped moving plate 28 is mounted to the pair of guide rails 26 in a state of being slidable along the guide rails 26. A nut section (not illustrated) is provided on a rear surface side (back surface side) of the moving plate 28. A ball screw 30 disposed substantially in parallel to the guide rails 26 is in screw engagement with the nut section. In addition, a pulse motor 32 is connected to an end part of the ball screw 30. When the ball screw 30 is rotated by the pulse motor 32, the moving plate 28 is moved along the Z-axis direction.

A grinding unit 34*a* that performs rough grinding of the workpiece 11 is fixed to a front surface side of the moving plate 28 possessed by the grinding feeding unit 24*a*. On the other hand, a grinding unit 34*b* that performs finish grinding of the workpiece 11 is fixed to the front surface side of the moving plate 28 possessed by the grinding feeding unit 24*b*. The grinding feeding units 24*a* and 24*b* relatively move the holding table 18 and the grinding units 34*a* and 34*b* in a direction perpendicular to a holding surface 18*a* (see FIG. 2) of the holding table 18, by lifting the grinding units 34*a* and 34*b* upward and downward.

Each of the grinding units 34*a* and 34*b* includes a hollow cylindrical housing 36. A cylindrical spindle 38 (see FIG. 2) disposed along the Z-axis direction is accommodated inside the housing 36. A tip part (lower end part) of the spindle 38 is exposed from the housing 36. In addition, a rotational drive source 40 is connected to a base end part (upper end part) of the spindle 38. For example, the rotational drive source 40 is a servo motor and rotates the spindle 38 around a rotational axis substantially parallel to the Z-axis direction.

Figure 2:
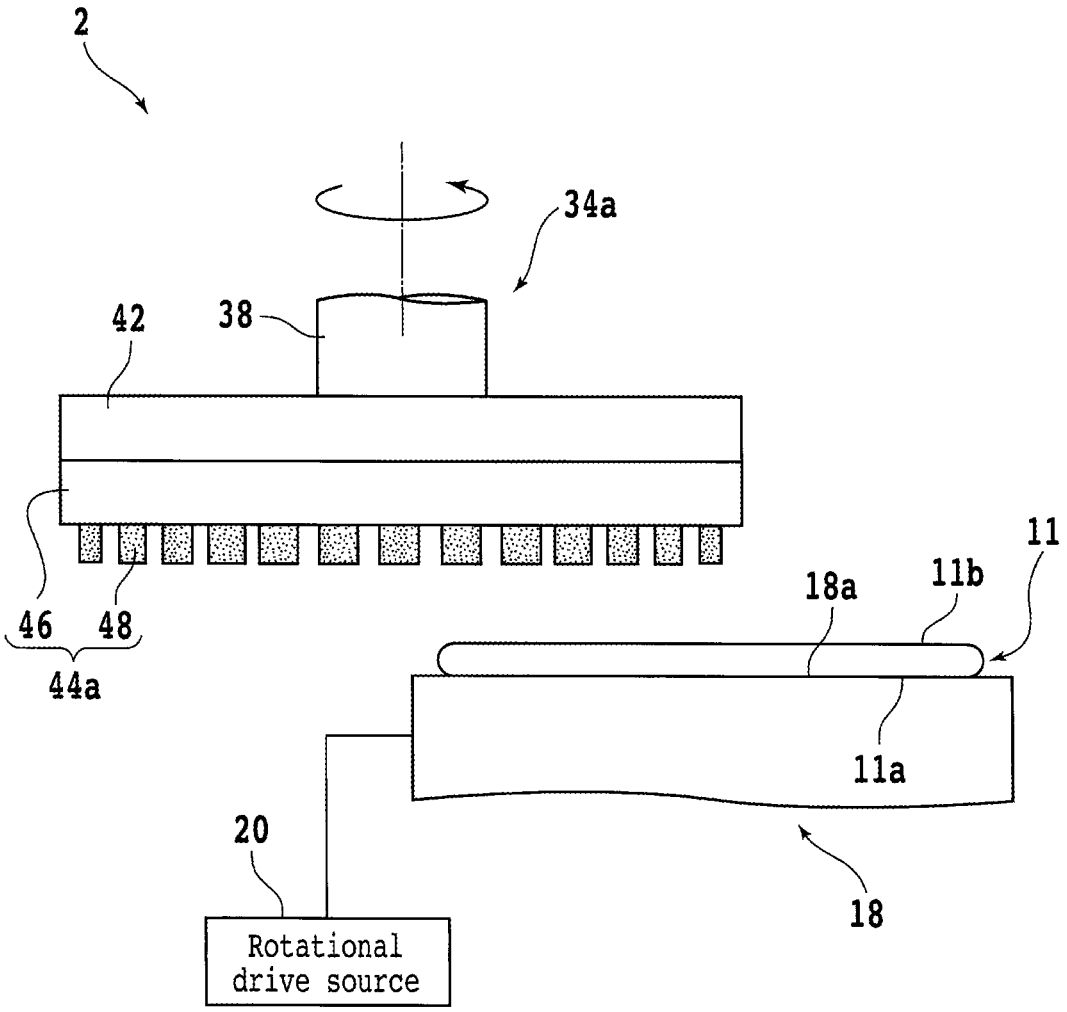
FIG. 2 is a front view depicting the grinding apparatus.

FIG. 2 is a front view depicting the grinding apparatus 2. FIG. 2 depicts the holding table 18 disposed at the first grinding position B and the grinding unit 34*a*.

An upper surface of the holding table 18 constitutes a holding surface 18*a* that holds the workpiece 11. The holding surface 18*a* is a flat surface substantially parallel to the X-axis direction and the Y-axis direction, and is formed, for example, in a circular shape correspondingly to the shape of the workpiece 11. In addition, the holding surface 18*a* is connected to a suction source (not illustrated) such as an ejector through a flow channel (not illustrated) formed inside the holding table 18, a valve (not illustrated), and the like. When a negative pressure of the suction source is made to act on the holding surface 18*a* in a state in which the workpiece 11 is disposed on the holding surface 18*a*, the workpiece 11 is held under suction by the holding table 18.

A disk-shaped mount 42 formed from a metal or the like is fixed to a lower end part of the spindle 38 of the grinding unit 34*a*. To a lower surface side of the mount 42, a grinding wheel 44*a* for rough grinding is mounted. The grinding wheel 44*a* is rotated around a rotational axis substantially parallel to the Z-axis direction, by power transmitted from the rotational drive source 40 (see FIG. 1) through the spindle 38 and the mount 42. The grinding wheel 44*a* includes an annular base 46 formed from a metal such as aluminum and stainless steel and formed to be substantially equal in diameter to the mount 42. On a lower surface side of the base 46, a plurality of rectangular parallelepiped-shaped grindstones 48 are arranged in an annular pattern along the circumferential direction of the base 46. For example, the grindstones 48 are formed by fixing abrasive grains of diamond, cubic boron nitride (cBN), or the like by a bonding material such as metal bond, resin bond, and vitrified bond. However, it is to be noted that the material, the shape, the structure, the size, and the like of the grindstones 48 are not limited, and the number of the grindstones 48 possessed by the grinding wheel 44*a* can also be set optionally.

The grinding unit 34*b* depicted in FIG. 1 is configured similarly to the grinding unit 34*a*. To a lower surface side of the mount 42 of the grinding unit 34*b*, a grinding wheel 44*b* for finish grinding is mounted. The configuration of the grinding wheel 44*b* is similar to that of the grinding wheel 44*a*. However, it is to be noted that an average grain diameter of abrasive grains contained in the grindstones 48 of the grinding wheel 44*b* is smaller than the average grain diameter of abrasive grains contained in the grindstones 48 of the grinding wheel 44*a*.

The grinding unit 34*a* grinds the workpiece 11 held by the holding table 18 positioned at the first grinding position B by the grinding wheel 44*a*. As a result, rough grinding is applied to the workpiece 11. In addition, the grinding unit 34*b* grinds the workpiece 11 held by the holding table 18 positioned at the second grinding position C by the grinding wheel 44*b*. As a result, finish grinding is applied to the workpiece 11. Note that, in the inside or the vicinity of each of the grinding units 34*a* and 34*b*, a grinding liquid supply passage (not illustrated) for supplying a liquid (grinding liquid) such as pure water is provided. The grinding liquid is supplied to the workpiece 11 and the grindstones 48 when grinding is applied to the workpiece 11.

In the vicinity of the holding table 18 positioned at the first grinding position B and in the vicinity of the holding table 18 positioned at the second grinding position C, a thickness measuring devices 50 for measuring a thickness of the workpiece 11 held by the holding table 18 are provided. The thickness measuring device 50 includes a height measuring device (height gauge) 52*a* for measuring the height of an upper surface of the workpiece 11 held by the holding table 18 and a height measuring device (height gauge) 52*b* for measuring the height of an upper surface (holding surface 18*a*) of the holding table 18. Then, the thickness measuring device 50 calculates the thickness of the workpiece 11, based on a difference between the values measured by the height measuring devices 52*a* and 52*b*.

At a position adjacent to the conveying unit 14 in the X-axis direction, a conveying unit (conveying mechanism, unloading arm) 54 for conveying the workpiece 11 is provided. The conveying unit 54 includes a suction pad for holding an upper surface side of the workpiece 11 under suction. The conveying unit 54 holds, by the suction pad, the workpiece 11 held by the holding table 18 positioned at the conveying position A, and, by turning the suction pad, conveys the workpiece 11 forward.

On the front side of the conveying unit 54, a cleaning unit (cleaning mechanism) 56 for cleaning the workpiece 11 conveyed by the conveying unit 54 is disposed. The workpiece 11 cleaned by the cleaning unit 56 is conveyed by the conveying unit 6 and is accommodated into the cassette 10*b*.

In addition, the grinding apparatus 2 includes a control unit (control section) 58 connected to the constituent elements constituting the grinding apparatus (the conveying unit 6, the alignment mechanism 12, the conveying unit 14, the turntable 16, the holding tables 18, the rotational drive source 20, the grinding feeding units 24*a* and 24*b*, the grinding units 34*a* and 34*b*, the thickness measuring device 50, the conveying unit 54, the cleaning unit 56, etc.). Operations of the constituent elements of the grinding apparatus 2 are controlled by the control unit 58. For example, the control unit 58 includes a computer, and includes a processing section that performs processing such as calculations required for operating the grinding apparatus 2, and a storage section that stores various kinds of information (data, program, etc.) used for processing by the processing section. The processing section is configured to include a processor such as a central processing unit (CPU). In addition, the storage section is configured to include various kinds of memories functioning as a main storage device, an auxiliary storage device, and the like. The control unit 58 executes programs stored in the storage section, thereby to generate signals (control signals) for controlling the constituent elements of the grinding apparatus 2.

Next, a specific example of the workpiece grinding method for grinding the workpiece 11 by use of the grinding apparatus 2 will be described. In the following, a case where the back surface 11*b* side of the workpiece 11 is ground to thin the workpiece 11 until the thickness of the workpiece 11 becomes a predetermined thickness (finished thickness) will be described as an example.

First, the workpiece 11 as an object of grinding by the grinding apparatus 2 is accommodated in the cassette 10*a*, and the cassette 10*a* is set on the cassette setting region 8*a*. Then, the workpiece 11 is taken out of the cassette 10*a* and conveyed to the alignment mechanism 12 by the conveying unit 6, and alignment of the workpiece 11 is conducted by the alignment mechanism 12. Thereafter, the workpiece 11 is conveyed from the alignment mechanism 12 to the holding table 18 disposed at the conveying position A by the conveying unit 14. For example, as depicted in FIG. 2, the workpiece 11 is disposed on the holding table 18 such that the front surface 11*a* side faces the holding surface 18*a* and the back surface 11*b* side is exposed on the upper side. When a negative pressure of the suction source is made to act on the holding surface 18*a* in this state, the workpiece 11 is held by the holding table 18 under suction. Note that, in the case where devices are formed on the front surface 11*a* side of the workpiece 11, a protective tape for protecting the devices may be preliminarily attached to the front surface 11*a* side of the workpiece 11. In this case, the workpiece 11 is held under suction by the holding table 18 through the protective tape.

Figure 3A:
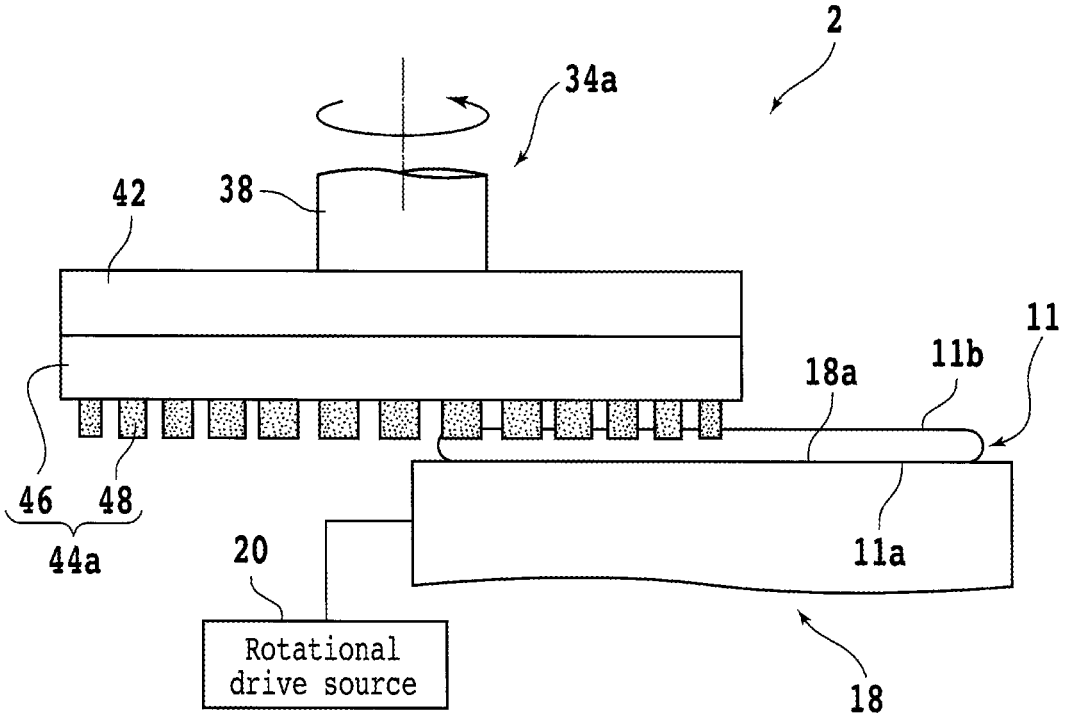
FIG. 3A is a front view depicting the grinding apparatus in a groove forming step.

Next, the turntable 16 is rotated, whereby the holding table 18 holding the workpiece 11 is disposed at the first grinding position B. Then, the workpiece 11 held by the holding table 18 is ground by the grinding unit 34*a*. In the present embodiment, first, the workpiece 11 is ground by the grinding unit 34*a*, to form the workpiece 11 with an arcuate groove (groove forming step). FIG. 3A is a front view depicting the grinding apparatus 2 in the groove forming step.

In the groove forming step, first, an angle in the rotating direction of the holding table 18 is set to a predetermined angle (for example, an initial angle (0°) by the rotational drive source 20. Then, the holding table 18 is not rotated, and the grinding wheel 44 is rotated at a predetermined rotational speed by the rotational drive source 40 (see FIG. 1). In this instance, the grindstones 48 of the grinding wheel 44*a* are rotated such as to pass through a position overlapping with the center of the workpiece 11. Then, the grinding wheel 44*a* is lowered at a predetermined speed (grinding feeding) by the grinding feeding unit 24*a*, and the rotating grindstones 48 are brought into contact with the back surface 11*b* (ground surface) side of the workpiece 11. When the grinding wheel 44*a* is lowered while the grindstones 48 are in contact with the back surface 11*b* side of the workpiece 11, the back surface 11*b* side of the workpiece 11 is ground by the grindstones 48. Note that a lowering speed of the grinding wheel 44*a* is adjusted such that the grindstones 48 are pressed against the back surface 11*b* side of the workpiece 11 with a suitable force.

Figure 3B:
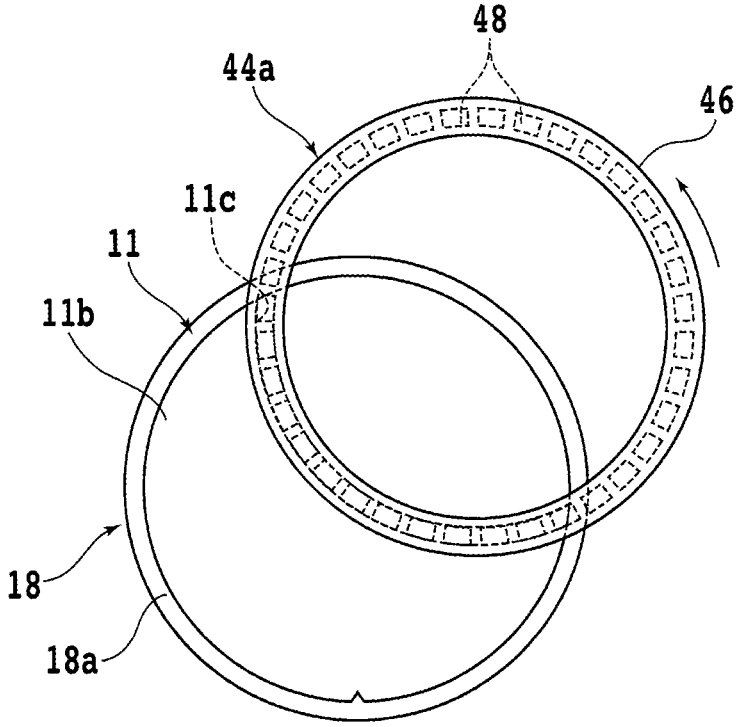
FIG. 3B is a plan view depicting a holding table and a grinding wheel in the groove forming step.

FIG. 3B is a plan view depicting the holding table 18 and the grinding wheel 44*a* in the groove forming step. When the workpiece 11 is ground with the holding table 18 not rotated and with the grinding wheel 44*a* rotated, the workpiece 11 is ground along a trajectory of the rotating grindstones 48. As a result, an arcuate groove 11*c* having the same width as a width of the grindstones 48 is formed on the back surface 11*b* side of the workpiece 11.

Figure 4A:
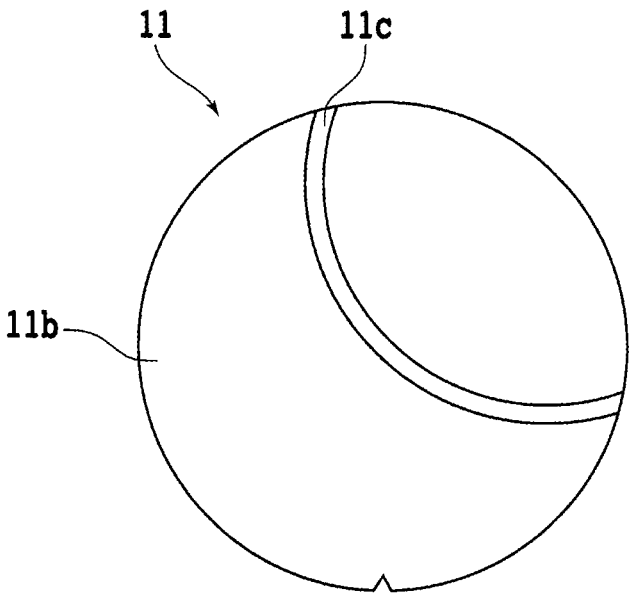
FIG. 4A is a plan view depicting a workpiece formed with a groove.

FIG. 4A is a plan view depicting the workpiece 11 formed with the groove 11*c*. The groove 11*c* is formed in an arcuate shape extending from one end of the workpiece 11, passing through the center of the workpiece 11 and reaching the other end of the workpiece 11. Then, when the grinding amount (depth of the groove 11*c*) of the workpiece 11 reaches to a predetermined value, grinding of the workpiece 11 by the grinding wheel 44*a* is stopped. Note that the groove 11*c* is formed in a depth of less than a final thickness (finished thickness) of the workpiece 11 after ground in the grinding step described later. For example, the depth of the groove 11*c* is set such that a difference between the finished thickness of the workpiece 11 and the depth of the groove 11*c* is equal to or more than 20 μm.

Figure 4B:
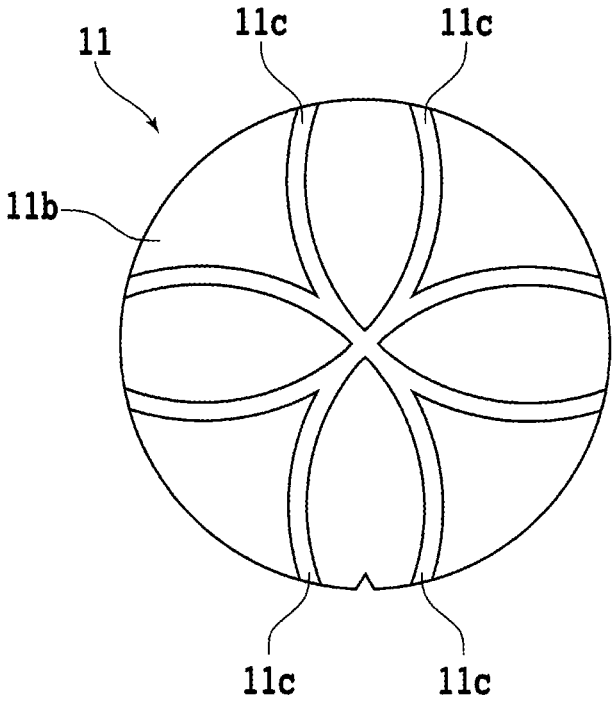
FIG. 4B is a plan view depicting the workpiece formed with a plurality of grooves.

In the groove forming step, the workpiece 11 may be formed with a plurality of the grooves 11*c*. In this case, after the first groove 11*c* is formed, the holding table 18 is rotated by a predetermined angle by the rotational drive source 20, to change the angle in the rotating direction of the holding table 18. Then, the workpiece 11 is ground by the grindstones 48, and the second arcuate groove 11*c* is formed on the back surface 11*b* side of the workpiece 11. Thereafter, the third and latter grooves 11*c* are formed in the same procedure. FIG. 4B is a plan view depicting the workpiece 11 formed with a plurality of grooves 11*c*. For example, after the first groove 11*c* is formed, a step of rotating the holding table 18 by 90° and grinding the workpiece 11 by the grindstones 48 is repeated three times, whereon four arcuate grooves 11*c* are formed on the back surface 11*b* side of the workpiece 11, as depicted in FIG. 4B. Thus, the workpiece 11 is ground in a state in which the angle in the rotating direction of the holding table 18 is different, whereby the workpiece 11 is formed with the plurality of grooves 11*c*.

Figure 5A:
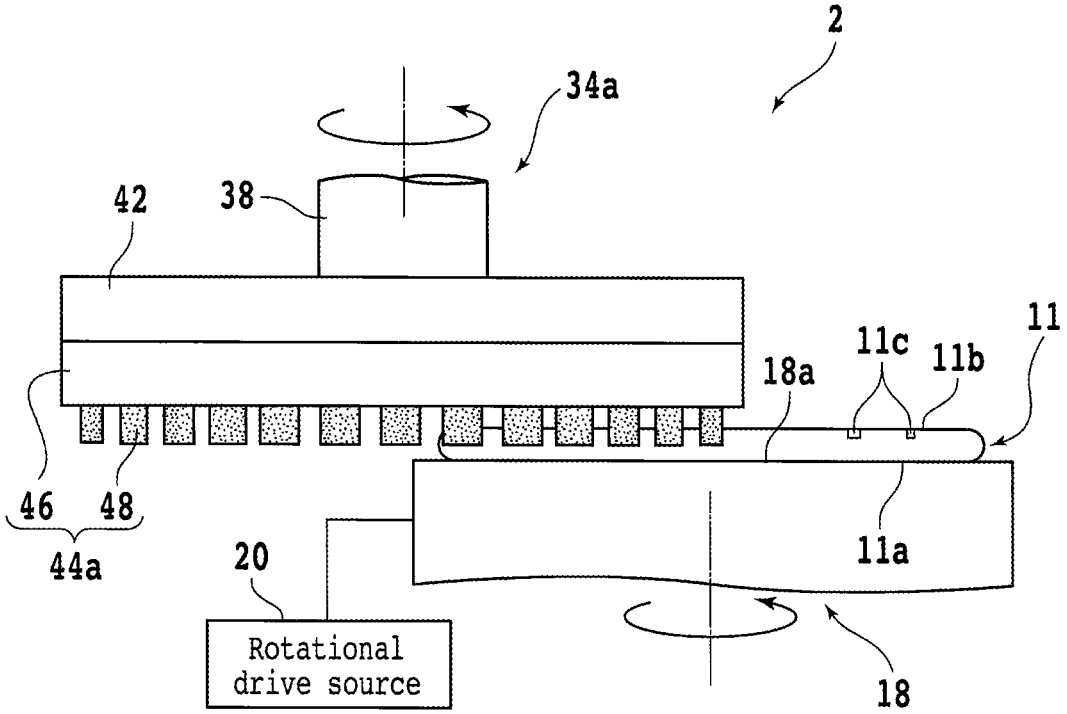
FIG. 5A is a front view depicting the grinding apparatus in a grinding step.

Subsequently, the workpiece 11 is ground until the thickness of the workpiece 11 becomes a finished thickness (grinding step). FIG. 5A is a front view depicting the grinding apparatus 2 in the grinding step. In the grinding step, the holding table 18 is rotated at a predetermined rotational speed by the rotational drive source 20, and the grinding wheel 44*a* is rotated at a predetermined rotational speed by the rotational drive source 40 (see FIG. 1). In this instance, the grindstones 48 of the grinding wheel 44*a* are rotated such as to pass a position overlapping with the center of the workpiece 11. Then, the grinding wheel 44*a* is lowered at a predetermined speed (grinding feeding) by the grinding feeding unit 24*a*, and the rotating grindstones 48 are brought into contact with the surface side (back surface 11*b* side) of the workpiece 11 where the grooves 11*c* are formed. When the grinding wheel 44*a* is lowered with the grindstones 48 in contact with the back surface 11*b* side of the workpiece 11, the back surface 11*b* side of the workpiece 11 is ground by the grindstones 48. Note that the lowering speed of the grinding wheel 44*a* is adjusted such that the grindstones 48 are pressed against the back surface 11*b* side of the workpiece 11 with a suitable force.

Figure 5B:
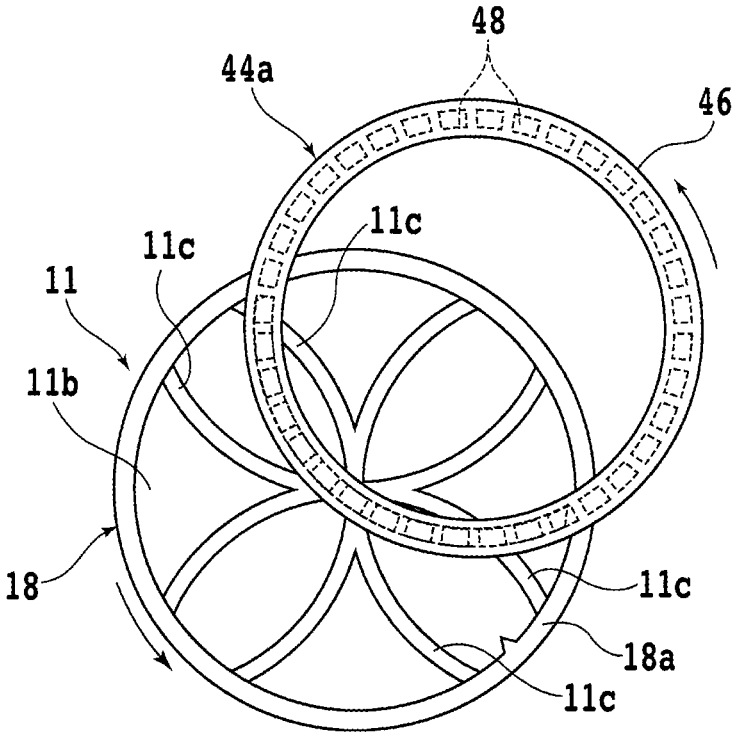
FIG. 5B is a plan view depicting the holding table and the grinding wheel in the grinding step.
Figure 6:
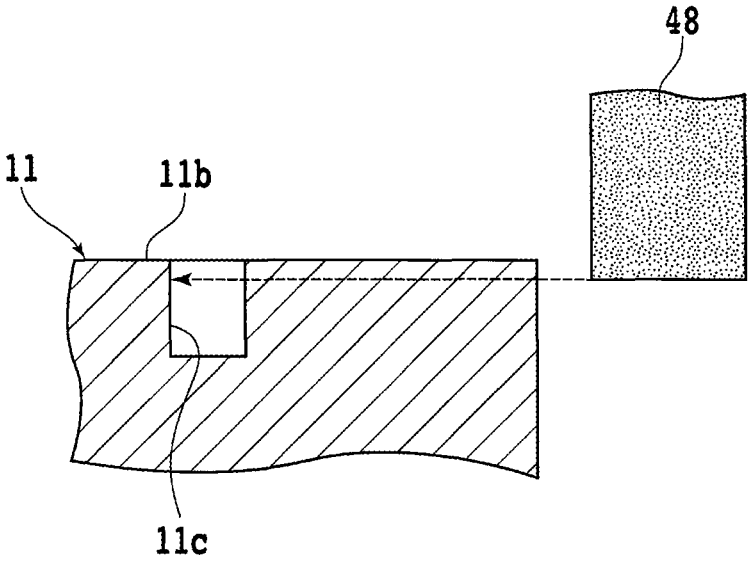
FIG. 6 is a sectional view depicting, in enlarged form, a part of the workpiece ground by grindstones.

FIG. 5B is a plan view depicting the holding table 18 and the grinding wheel 44*a* in the grinding step. When the workpiece 11 is ground with the holding table 18 and the grinding wheel 44*a* being rotated, the whole part on the back surface 11*b* side of the workpiece 11 is ground, whereby the workpiece 11 is thinned. FIG. 6 is a sectional view depicting, in enlarged form, a part of the workpiece 11 ground by the grindstones 48. During grinding of the workpiece 11, the plurality of grindstones 48 each make contact from a peripheral edge toward the center of the workpiece 11. Then, when the rotating grindstones 48 passes through the groove 11*c*, a lower surface side of the grindstones 48 collides against the inner walls of the groove 11*c*, whereby abrasion of the bonding material of the grindstones 48 is liable to occur. As a result, spontaneous edge sharpening in which the abrasive grains in the state of being embedded inside the bonding material is exposed from the bonding material is promoted, and a lowering in the grinding ability of the grindstones 48 is restrained. Particularly, in the case where a thin film of an oxide film or the like is formed on the back surface 11*b* side of the workpiece 11, the grindstones 48 are captured by the thin film and are liable to drop from the bonding material. However, since the spontaneous edge sharpening of the grindstones 48 is promoted by the grooves 11*c* as above-mentioned, the grinding ability of the grindstones 48 can be recovered swiftly.

Figure 7:
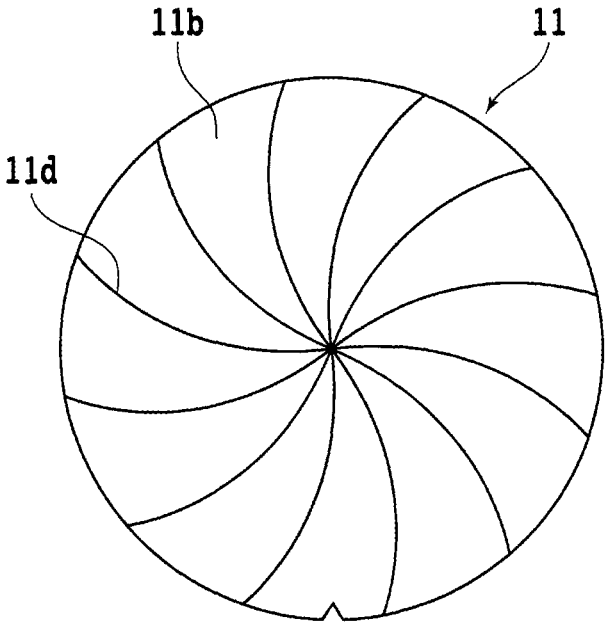
FIG. 7 is a plan view depicting the workpiece after grinding.

When the workpiece 11 is ground until the thickness of the workpiece 11 reaches a predetermined thickness (finished thickness), grinding of the workpiece 11 by the grinding wheel 44*a* is stopped. As a result, rough grinding of the workpiece 11 is completed. FIG. 7 is a plan view depicting the workpiece 11 after grinding. On the back surface 11*b* side of the workpiece 11 after the grinding, grinding marks (saw marks) 11*d* formed radially from the center toward a peripheral edge of the workpiece 11 are left. The grinding marks 11*d* are formed in a curved line shape along the trajectory of the rotating grindstones 48. Note that, during the grinding of the workpiece 11 by the grinding wheel 44*a*, the thickness of the workpiece 11 is measured by the thickness measuring device 50 (see FIG. 1). Then, based on the thickness of the workpiece 11 measured by the thickness measuring device 50, the timing for stopping the grinding of the workpiece 11 by the grinding unit 34*a* is controlled.

Next, the turntable 16 is rotated, and the holding table 18 holding the workpiece 11 is disposed at the second grinding position C. Then, the workpiece 11 held by the holding table 18 positioned at the second grinding position C is ground by the grinding unit 34*b*. As a result, finish grinding of the workpiece 11 is conducted, and the grinding marks 11*d* (see FIG. 7) formed on the back surface 11*b* side of the workpiece 11 are removed. Operations of the holding table 18 and the grinding unit 34*b* at the time of finish grinding are similar to the operations of the holding table 18 and the grinding unit 34*a* at the time of rough grinding. In addition, during grinding of the workpiece 11 by the grinding wheel 44*b*, the thickness of the workpiece 11 is measured by the thickness measuring device 50.

Note that, at the time of finish grinding, also, the groove forming step and the grinding step as above-mentioned may be carried out. Specifically, first, in a state in which the holding table 18 is not rotated and the grinding wheel 44*b* is rotated, the grindstones 48 are brought into contact with the workpiece 11, to form the grooves 11*c* on the back surface 11*b* side of the workpiece (see FIGS. 3A and 3B). Thereafter, in a state in which the holding table 18 and the grinding wheel 44*b* are rotated, the grindstones 48 are brought into contact with the workpiece 11, to grind the whole part on the back surface 11*b* side of the workpiece 11 (see FIGS. 5A and 5B). As a result, at the time of finish grinding of the workpiece 11, also, spontaneous edge sharpening of the grindstones 48 is promoted.

Next, the turntable 16 is rotated, and the holding table 18 holding the workpiece 11 is disposed at the conveying position A. Then, from a position on the holding table 18 positioned at the conveying position A, the workpiece 11 after processing is conveyed. The workpiece 11 held by the holding table 18 positioned at the conveying position A is conveyed by the conveying unit 54 from the position on the holding table 18 to the cleaning unit 56, and is cleaned. After the cleaning by the cleaning unit 56, the workpiece 11 is conveyed into the cassette 10*b* by the conveying unit 6.

As described above, the workpiece grinding method according to the present embodiment includes the groove forming step of forming the arcuate grooves 11*c* having a depth of less than the finished thickness of the workpiece 11, and the grinding step of bringing the grindstones 48 into contact with the surface side of the workpiece 11 where the grooves 11*c* are formed, to grind the workpiece 11 until the thickness of the workpiece 11 becomes the finished thickness. By this, at the time of grinding the workpiece 11 to thin the workpiece 11, the grindstones 48 collide against the grooves 11*c*, whereby spontaneous edge sharpening is promoted. As a result, the grinding ability of the grindstones 48 is maintained, and generation of defective processing is restrained.

Note that operations of the grinding apparatus 2 in the groove forming step and the grinding step as above-mentioned are controlled by the control unit 58. Specifically, in the groove forming step, the control unit 58 outputs a control signal to the rotational drive source 20 (see FIG. 2 and the like), to thereby set the angle in the rotating direction of the holding table 18 to a predetermined angle, and thereafter maintains the holding table 18 in a stopped state (a state of not being rotated). In addition, the control unit 58 outputs a control signal to the rotational drive source 40 of the grinding unit 34*a*, to thereby rotate the grinding wheel 44*a* at a predetermined rotational speed. Then, the control unit 58 outputs a control signal to the pulse motor 32 of the grinding feeding unit 24*a*, to thereby rotate the ball screw 30 at a predetermined speed. As a result, the grinding unit 34*a* is lowered at a predetermined speed, the grindstones 48 are brought into contact with the workpiece 11, and the groove 11*c* is formed in the workpiece 11. In other words, the control unit 58 outputs control signals to the constituent elements of the grinding apparatus 2, to thereby operate the grinding apparatus 2 in a mode (first mode) for carrying out the groove forming step.

On the other hand, in the grinding step, the control unit 58 outputs a control signal to the rotational drive source 20 (see FIG. 2 and the like), thereby to rotate the holding table 18 at a predetermined rotational speed. In addition, the control unit 58 outputs a control signal to the rotational drive source 40, thereby to rotate the grinding wheel 44*a* at a predetermined rotational speed. Then, the control unit 58 outputs a control signal to the pulse motor 32 of the grinding feeding unit 24*a*, thereby to rotate the ball screw 30 at a predetermined speed. As a result, the grinding unit 34*a* is lowered at a predetermined speed, the grindstones 48 are brought into contact with the workpiece 11, and the whole part on the back surface 11*b* side of the workpiece 11 is ground. In other words, the control unit 58 outputs the control signals to the constituent elements of the grinding apparatus 2, thereby operating the grinding apparatus 2 in a mode (second mode) for carrying out the grinding step.

As described above, after the holding table 18 holding the workpiece 11 is positioned at the first grinding position B, the first mode and the second mode are switched over, as required, by the control unit 58, whereby the groove forming step and the grinding step are carried out. Note that the operations of the control unit 58 in the case of carrying out the groove forming step and the grinding step by use of the grinding unit 34*b* are similar to the above.

In the case where a plurality of the grooves 11*c* are formed in the groove forming step (see FIG. 4B), the control unit 58 outputs a control signal to the rotational drive source 20 (see FIG. 2), thereby to stop the holding table 18 at a predetermined angular interval (for example, 90° interval). Then, the workpiece 11 is ground by the grinding unit 34*a* in a state in which the angle of the holding table 18 is different, whereby the grooves 11*c* are formed. Note that the control of the angle of the holding table 18 by the control unit 58 is carried out based on a signal inputted from an encoder possessed by the rotational drive source 20. Specifically, the encoder detects the rotational angle of an output shaft of the rotational drive source 20, and outputs the rotational angle to the control unit 58. Then, the control unit 58 calculates a rotational amount of the output shaft of the rotational drive source 20 necessary for stopping the holding table 18 at a desired angle, based on the detection result of the encoder, and rotates the output shaft of the rotational drive source 20 by the rotational amount.

Other than the above-mentioned, the structures, the methods, and the like concerning the above embodiment may be modified, as required, in carrying out the present invention insofar as the modifications do not depart from the scope of the object of the invention.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding method for a workpiece for grinding the workpiece by a grinding apparatus including a holding table that holds the workpiece by a holding surface, and a grinding unit that grinds the workpiece held by the holding table by a grinding wheel having a plurality of grindstones arranged in an annular pattern, the grinding method comprising:

a groove forming step of grinding the workpiece by bringing the grindstones into contact with the workpiece, in a state in which the holding table is not rotated and the grinding wheel is rotated, to form the workpiece with an arcuate groove having a depth of less than a finished thickness of the workpiece; and a grinding step of bringing the grindstones into contact with a surface side of the workpiece where the groove is formed, in a state in which the holding table and the grinding wheel are rotated, to grind the workpiece until the thickness of the workpiece becomes the finished thickness.

2. The grinding method according to claim 1, wherein, in the groove forming step, the workpiece is ground in a state in which an angle in a rotating direction of the holding table is set to a predetermined angle.

3. The grinding method according to claim 1, wherein, in the groove forming step, the workpiece is ground respectively in states in which angles in a rotating direction of the holding table are different, to form the workpiece with a plurality of the grooves.

4. A grinding apparatus comprising:

a holding table that holds a workpiece by a holding surface;

a grinding unit that grinds the workpiece held by the holding table by a grinding wheel having a plurality of grindstones arranged in an annular pattern;

a grinding feeding unit that relatively moves the holding table and the grinding unit along a direction perpendicular to the holding surface; and a control unit that controls the holding table, the grinding unit, and the grinding feeding unit, wherein the control unit changes over a first mode of bringing the grindstones into contact with the workpiece by the grinding feeding unit, in a state in which the holding table is not rotated and the grinding wheel is rotated, to form the workpiece with a groove having a depth of less than a finished thickness of the workpiece, and a second mode of bringing the grindstones into contact with a surface side of the workpiece where the groove is formed by the grinding feeding unit, in a state in which the holding table and the grinding wheel are rotated, to grind the workpiece until the thickness of the workpiece becomes the finished thickness.

5. The grinding apparatus according to claim 4, wherein the control unit controls an angle in a rotating direction of the holding table.

* * * * *